US005183515A

United States Patent [19]

Ueno et al.

[11] Patent Number: 5,183,515

[45] Date of Patent: Feb. 2, 1993

[54] FIBROUS ANISOTROPIC PERMANENT MAGNET AND PRODUCTION PROCESS THEREOF

[75] Inventors: Shuji Ueno; Michiaki Hagiwara, both of Kyoto; Ryoji Mishima; Kiyoshi Isoishi, both of Kanagawa, all of Japan

[73] Assignees: Unitika Ltd., Hyogo; Mitsubishi Kasei Corporation, Tokyo, both of Japan

[21] Appl. No.: 860,992

[22] Filed: Mar. 31, 1992

Related U.S. Application Data

[62] Division of Ser. No. 609,843, Nov. 7, 1990, Pat. No. 5,135,585.

[30] Foreign Application Priority Data

Nov. 7, 1989 [JP] Japan ..... 1-289446

[51] Int. Cl.[5] ..... H01F 1/02

[52] U.S. Cl. ..... 148/101; 148/121; 420/590; 420/83; 420/121; 164/462

[58] Field of Search ..... 420/590, 83, 121; 148/101, 102, 121; 164/462; 264/24, 108, 211.12, 211.13, 211.14

[56] References Cited

U.S. PATENT DOCUMENTS 4,842,656 6/1989 Maines et al. ..... 148/302
4,844,754 7/1989 Lee ..... 148/302

FOREIGN PATENT DOCUMENTS 0260746 3/1988 European Pat. Off. .

OTHER PUBLICATIONS

The American Heritage Dictionary of the English Language, 1976, p. 487.

Patent Abstracts of Japan, vol. 13, No. 462 (M-881)(3810) Oct. 19, 1989 & JP-01-180-757 (Toyobo Co., Ltd.) Jul. 18, 1989.

Patent Abstracts of Japan, vol. 13, No. 51 (E-712) (3399) Feb. 6, 1989 & JP-63-244-704 (Seiko Epson Corp.) Oct. 12, 1988.

Patent Abstracts of Japan, vol. 13, No. 304 (E-786) (3652) Jul. 12, 1989 & JP-62-239855 (Seiko Electronic Components Ltd.) Sep. 24, 1987.

*Primary Examiner*—John P. Sheehan

*Attorney, Agent, or Firm*—Sughrue, Mion, Zinn, Macpeak & Seas

[57] ABSTRACT

A fibrous anisotropic permanent magnet is disclosed comprising fibers composed of an alloy comprising at least one of a rare earth metal selected from Nd, Pr, Dy, Ho, Tb, La, and Ce; Fe or Fe and Co; and B, said fibers having a mean diameter of from 50 to 1,000 μm and exhibiting magnetic anisotropy. The fibrous anisotropy permanent magnet is prepared by extruding a molten alloy comprising at least one of Nd, Pr, Dy, Ho, Tb, La, and Ce; Fe or Fe and Co; and B in an oil to quench-solidify the molten alloy into a fibrous form.

Since the fibrous magnet exhibits excellent anisotropic magnetic characteristics in the lengthwise direction of the fiber axis in the quench-solidified state, the magnet is particularly useful as a magnetic powder material for an anisotropic bond magnet.

2 Claims, No Drawings

FIBROUS ANISOTROPIC PERMANENT MAGNET AND PRODUCTION PROCESS THEREOF

This is a divisional of application Ser. No. 07/609,843 filed Nov. 7, 1990 now U.S. Pat. No. 5,135,585.

FIELD OF THE INVENTION

The present invention relates to a fibrous anisotropic permanent magnet comprising as main components a rare earth element, iron or iron and cobalt, and boron, and to a process for preparing the magnet.

BACKGROUND OF THE INVENTION

Recently, a Nd-Fe-B system magnet has been developed which exhibits a maximum magnet energy product superior to a Sm-Co system magnet. The aforesaid magnet is considered to be useful in various applications such as in the area of high-performance miniature magnets.

It is generally known that the maximum magnetic energy product of a magnet material composed of a rare earth element and Fe or Fe and Co is greatly improved by imparting thereto a magnetic anisotropic property. In this regard, a number of processes for producing a Nd-Fe-B system magnetic material having excellent magnetic characteristics have been proposed.

As an example of a typical process for preparing a Nd-Fe-B system magnet having magnetic anisotropy, it is proposed in JP-A-59-46008 (the term "JP-A" as used herein means an "unexamined published Japanese patent application" that the magnet can be prepared using a conventional powder metallurgy technique. JP-A-59-46008 further describes a process for preparing an anisotropic magnet comprising preparing an alloy ingot of Nd, Fe, and B, next pulverizing the alloy ingot into a fine powder, and then consolidating the powder in a magnetic filed followed by sintering.

However, the anisotropic magnet produced by the above described process is disadvantageous in that the magnet can not be used as a magnetic powder for preparing a bonded magnet.

Apart from the above described powder metallurgy method, the rapid quenching method from the melt proposed in JP-A-59-64739 and JP-A-59-211549 describes a process for preparing a magnet material by forming a ribbon-form amorphous alloy from a molten alloy of Nd, Fe, and B. A rapid quenching technique such as melt spinning is then used followed by heat-treating the amorphous alloy ribbons to crystallize the $Nd_2Fe_{14}B$ phase.

Furthermore, JP-A-60-9852 proposes a quenched ribbon form magnet material containing fine crystal particles of a $Nd_2Fe_{14}B$ phase.

The magnet material disclosed in JP-A-59-64739, JP-A-59-211549, and JP-A-60-9852 as noted above have a high intrinsic coercive force of from 8 kOe to 15 kOe but are disadvantageous in that the magnet materials are isotropic and the maximum magnetic energy product, an important magnetic property, is not sufficiently increased.

A process for preparing an anisotropic magnet using flakes of amorphous alloy ribbons produced by a rapid quenching technique is proposed in JP-A-60-100402. The process comprises first hot pressing powdered Nd-Fe-B system amorphous alloy ribbons, next hot-deforming the bulk and orienting the axes of the crystal that are reading magnetized in the same direction based on the plastic flow. However, the production process of the above described anisotropic Nd-Fe-B system magnetic material is disadvantageous in that complicated steps are required, the production time is inevitably prolonged, the productivity is low, and the production cost is very high.

On the other hand, a high-performance miniature magnet other than the above described quenched ribbon-form magnet material and a process of producing the same are proposed in JP-A-1-180757. Particularly, JP-A-1-180757 describes a fibrous Nd-Fe-B system hard magnetic material having a diameter of less than 500 μm formed by spinning into fiber-form and solidifying. JP-A-1-180757 further describes that the magnetic material can be produced by method of spinning in a rotating liquid using water as the cooling medium.

However, when the present inventors sought to produce a Nd-Fe-B system hard magnetic material by a method of spinning in a rotating liquid using water as the cooling medium in accordance with the teachings of JP-A-1-180757, a miniature fibrous material having a diameter of less than 500 μm was obtained. However, the surface of each fiber was covered by a thick oxide film, the intrinsic coercive force (iHc) (a magnetic characteristic of the resulting material was only from about 3 kOe to 5 kOe, and the maximum magnetic energy product was even less. Thus, the present inventors have determined that a fibrous permanent magnet having excellent magnetic characteristics is not obtained by the process described in JP-A-1-180757.

Also, a method of spinning in a rotating liquid using water as the cooling medium for obtaining a fibrous permanent magnet is disadvantageous in that there is almost no difference in the fibrous permanent magnet thus obtained between the magnetic characteristics (e.g., coercive force and residual magnetic flux density) in the lengthwise direction of the fiber axis and those in the direction perpendicular to the fiber axis. In other words, a fibrous permanent magnet having anisotropy is not obtained.

SUMMARY OF THE INVENTION

A first object of the present invention is to provide a miniature fibrous anisotropic rare earth element-Fe or Fe/Co-B system permanent magnet having excellent intrinsic coercive force, maximum magnetic energy product, residual magnetic flux density and anisotropy, and which can be utilized as a magnetic powder for a bonded magnet.

A second object of the present invention is to provide a low cost process for producing the above described fibrous anisotropic permanent magnet.

As a result of various investigations, the present inventors have discovered that the above objectives are attained by providing a fibrous rare earth metal-Fe or Fe/Co-B system magnet having excellent magnet characteristics, which magnet is anisotropic even in a quenched state, and which magnet can be obtained by a rapid quenching method using an oil as the cooling medium.

In accordance with a first embodiment of the present invention, a fibrous anisotropic permanent magnet is provided comprising fibers composed of an alloy comprising at least one of a rare earth element selected from the group consisting of Nd, Pr, Dy, Ho, Tb, La, and Ce; Fe or Fe and Co; and B, said fibers having a mean diameter of from 50 to 1,000 μm and exhibiting magnetic anisotropy.

In accordance with a second embodiment of the present invention, a process for preparing a fibrous anisotropic permanent magnet is provided, comprising extruding a molten alloy comprising at least one rare earth element selected from the group consisting of Nd, Pr, Dy, Ho, Tb, La, and Ce; Fe or Fe and Co; and B into an oil to cool and solidify the molten alloy into a fibrous form.

The fibrous anisotropic permanent magnet of the present invention exhibits excellent magnetic characteristic including a high degree of anisotropy in the lengthwise direction of the fiber axis in the quench-solidified state and in particular, an intrinsic coercive force of at least 8 kOe under an applied magnetic filed of about 15 kOe. The magnet can be widely utilized in the audio or communication fields as well as for other various devices.

Also, since the magnet of the present invention may be prepared using a rapid quenching method, the magnet can be used as magnetic powders for a bonded magnet.

Furthermore, since a rapid quenching method may be employed, the fibrous magnet of the present invention is readily produced in commercial quantities at low cost.

DETAILED DESCRIPTION OF THE INVENTION

The magnet of the present invention is prepared by quench-solidifying into fibrous form a molten alloy of a rare earth metal-iron-boron system or rare earth metal-iron-cobalt-boron system alloy using an oil as the cooling medium. The resulting magnet is mainly composed of a $Nd_2Fe_{14}B$ type phase and a non-equilibrium phase. Also, the fibrous magnet of the present invention is an anisotropic magnet material which exhibits excellent magnetic characteristics, e.g., an intrinsic coercive force in the lengthwise direction of the fiber axis of at least 8 kOe under an applied magnetic field of about 15 kOe in a quench-solidified state, and which exhibits excellent anisotropic properties. Particularly, the coercive force and residual magnetic flux density are respectively from 1.3 to 10 times, preferably 1.5 to 5 times, more preferably 2.5 to 5 times, as strong in the lengthwise direction of the fiber axis as compared to the same magnetic characteristics in the direction perpendicular to the lengthwise fiber axis.

The alloy composition of the fibrous anisotropic permanent magnet of the present invention preferably is an alloy system forming a $Nd_2Fe_{14}$ B type compound as the main phase in the quench solidification. In particular, an alloy composed of from 8 to 30 atom % of at least one of Nd, Pr, Dy, Ho, Tb, La, and Ce; from 2 to 28 atom % of B; not more than 30 atom % of Co; and the remainder being substantially Fe is preferred. An alloy composed of from 8 to 20 atom % of at least one of Nd, Pr, Dy, Ho, Tb, La, and Ce; from 4 to 15 atom % of B; not more than 30 atom % of Co; and the remainder being substantially Fe is particularly preferred. Furthermore, an alloy containing Nd in an amount of at least 50 atom % of the total rare earth metal content is preferred. Also, it is preferred that the ratio of Co/(Fe+Co) is less than 0.2.

Also, the alloy composition of the present invention may further contain from 0.001 to 3 atom % of at least one of Si, Al, Nb, Zr, Mo, Hf, P and C as an additive.

As the form of the fiber of the magnet of the present invention, the cross-section thereof may be an ellipse or a circle, but a cross-section approximating a circle is preferred.

The mean diameter of the fiber of the present invention is obtained as follows. A mean value of the maximum diameter (long axis) and the minimum diameter (short axis) of a cross section of the fiber is determined, and such mean values are determined at a total of 10 different cross sections of the magnet. The mean value of the 10 cross sections is employed as the mean diameter.

In order to obtain anisotropic magnetic characteristics, the maximum mean diameter of the fibers is not greater than 1 mm, and in particular, in order to obtain magnetic characteristics of excellent high coercive force, the maximum diameter is preferably not greater than 0.2 mm. In order to stably prepare the fibrous magnet, the minimum diameter is at least 0.05 mm. Also, it is preferred that the fibrous magnet of the present invention has the length of from 10 to $10^6$ times, preferably 300 to $3\times10^5$ times, more preferably $10^3$ to $10^5$ times, of the mean diameter thereof.

For obtaining a fibrous anisotropic magnet of the present invention, a rapid quenching method of obtaining fibrous solidified products having a circular or elliptical cross-section may be employed, but it is necessary to use an oil as the cooling medium for the rapid quenching method of the present invention.

As the rapid quenching method, various methods such as the method disclosed, e.g., in JP-A-49-135820 can be used, but of these methods, the method of spinning in a rotating liquid as disclosed in JP-A-55-64948 is preferred. In this method, a cooling liquid is placed in a rotary drum, a liquid film is formed on the inside wall of the drum by means of a centrifugal force, and a molten metal is ejected into the liquid film to quench solidify fibers having a circular or elliptical cross-section. By selecting a ejecting pressure of from 3 to 10 atoms, a liquid phase surface speed of from 300 to 1,000 meters/min., an incident angle of the molten alloy into the liquid film phase of from 20 to 70 degrees, and a nozzle diameter of from 50 to 1,000 μm, and by using an oil as the cooling medium, the fibrous anisotropic magnet of the present invention can be obtained.

Also, the fibrous anisotropic magnet of the present invention can be obtained using rapid quenching methods which provide a fibrous quench-solidified product other than the above described method of spinning in a rotating liquid of JP-A-55-64948, by using an oil as the cooling medium.

The oil for use in the present invention includes mineral oils, fatty acid ester series oils, and various silicone oils. To avoid reaction of the oil with the large rare earth element(s) content of the molten metal, preferably used are oils having low reactivity, which do not have the surface of the quench-solidified fibers covered by a thick oxide film, such as mineral system quenching oils of from first class to third class of JIS Standard, dimethyl silicone oil and methylphenyl silicone oil. Also, the viscosity of the oil for use in the present invention, measured, for example, at 20° C. using a capillary viscometer or a rotation viscometer, is from 1 to 1,000 c.p., preferably 1 to 500 c.p., more preferably 1 to 100 c.p. If an oil having a viscosity of higher than 1,000 c.p. is used, the molten metal extruded in a molten state strongly collides against the surface of the rotating cooling medium not to stably dive into the cooling medium, whereby sufficient quenching effect is not obtained with the result that the fibrous anisotropic magnet of the present invention is not produced.

Also, by heat treating the fibrous anisotropic quenched magnet of the present invention, the maximum magnetic energy product may be further improved. The heat treatment is preferably carried out at a temperature of from 300° to 800° C. for a time period of from 0.01 to 10 hours. It is preferred that the heat treating is carried out in an atmosphere of inert gas such as argon, or under vacuum or reduced pressure of $10^{-2}$ atm or less.

The present invention is further explained in detail by reference to the following non-limiting examples.

EXAMPLE 1

Quench-solidified fibers of an alloy composed of 15 atom % Nd, 75 atom % Fe, and 10 atom % B was prepared by the method of spinning in a rotating liquid. The diameter of the rotary drum used was 500 mm, the diameter of the spinning nozzles (quartz) was 125 μm, the cooling medium was dimethyl silicone oil having a viscosity of 10 c.p., made by Takemoto Yushi K.K., and the temperature was 20° C. The production conditions were as follows. The ejecting pressure was 4.5 atms, the drum was rotated at 300 r.p.m., the molten metal temperature was 1,250° C., and the incident angle was 60 degrees.

The quench-solidified fibers thus obtained were embedded in a resin and the cross-section was observed by an optical microscope. The fibers had a circular cross-section having a mean diameter of 120 μm. Also, when X ray diffraction was conducted using a Cu-Kα line, it was confirmed that the fibers were Nd-Fe-B system quench-solidified fibers composed mainly of a $Nd_2Fe_{14}B$ phase.

Furthermore, quench-solidified fibers thus obtained were cut into a length of 10 mm each and then 20 of them were positioned on an adhesive tape in the state that the fiber axes thereof were parallel each other. The magnetic characteristics thereof in the direction perpendicular to the fiber axis and in the lengthwise direction of the fiber axis were measured by means of vibrating sample magnetometer (VSM) (Type VSM-3S, made by Toei K.K.). The residual magnetic flux density (Br(kG), the intrinsic coercive force iHc (kOe), and the maximum magnetic energy product in both of these directions were measured, the results of which are shown in Table 1 below. The applied magnetic field used in making these measurements was 15 kOe.

TABLE 1

| | Direction | iHc (kOe) | Br (kG) | (BH) max (MGOe) |
|---|---|---|---|---|
| Example 1 | Perpendicular to fiber axis | 6.9 | 4.6 | 4.0 |
| | Lengthwise to fiber axis | 10.8 | 7.1 | 9.6 |
| Comparative Example 1 | Perpendicular to fiber axis | 2.9 | 4.2 | 1.5 |
| | Lengthwise to fiber axis | 3.1 | 4.5 | 1.7 |
| Comparative Example 2 | Perpendicular to the lenghtwise direction of ribbon | 9.5 | 5.2 | 6.2 |
| | Lengthwise to ribbon | 9.8 | 5.1 | 6.3 |

COMPARATIVE EXAMPLE 1

Quench-solidified fibers of an alloy composed of 5 atom % Nd, 75 atom % Fe, and 10 atom % B were prepared by the same method of spinning in a rotating liquid as in Example 1, except that water of 4° C. was used as the cooling medium.

The quench-solidified fibers thus prepared were embedded in a resin and the cross-section thereof was observed by an optical microscope. The fibers had a circular cross-section having a mean diameter of 120 μm. Also, when the fibers were analyzed by X-ray diffraction using a Cu-Kα line, it was confirmed that the fibers were Nd-Fe-B system quench-solidified fibers composed of an oxide $Nd_2O_3$ phase thickly covering the surface of the fiber and a $Nd_2Fe_{14}B$ phase contained in the inside of the fiber.

Furthermore, the magnetic characteristics of the fibers thus obtained were measured by the same manner as in Example 1, and the results obtained are shown in Table 1 above.

COMPARATIVE EXAMPLE 2

A quench-solidified ribbon of an alloy composed of 15 atom % Nd, 75 atom % Fe, and 10 atom % B was prepared using a single roll quenching apparatus. The copper roll diameter used was 20 cm and the diameter of the spinning nozzles (quartz) was 0.5 mm. The production conditions were as follows. The ejecting pressure was 0.5 atm., the roll rotation number was 1,000 (roll circumferential speed 10.5 meter/sec.), and the molten metal temperature was 1,350° C.

The quench-solidified ribbon thus obtained was embedded in a resin, and the cross-section was observed by an optical microscope. The ribbon had a rectangular section having a mean thickness (of 10 sections) of about 50 μm and a width of from 1 to 2 mm. Also, when the ribbon was analyzed by an X-ray diffraction using a Cu-Kα line, it was confirmed that the ribbon was a Nd-Fe-B system quench-solidified ribbon composed of a $Nd_2Fe_{14}B$ phase and an amorphous phase.

Furthermore, 10 such quench-solidified ribbon cut into 10 mm in length were arranged together and the magnetic characteristics in the direction perpendicular to the lengthwise direction of the ribbon and in the lengthwise direction of the ribbon were measured by vibrating sample magnetometer.

The residual magnetic flux density Br(kG) and the coercive force iHc (kOe) in these directions are shown in Table 1 above. In addition, the applied magnetic filed used for the measurement was 20 kOe.

From the results shown in Table 1 above, it is clearly seen that the quench-solidified fibers of Example 1 of the present invention prepared by the method of spinning in a rotating liquid using an oil as the cooling medium exhibit remarkably superior magnetic characteristics, including coercive force and residual magnetic flux density, as compared to the quench-solidified fibers of Comparative Example 1 prepared using by the same technique, except for using water as the cooling medium. Furthermore, in Comparative Example 1, the magnetic characteristics (coercive force and residual magnetic flux density) in the direction perpendicular to the fiber axis are almost same as the magnetic characteristics (coercive force and residual magnetic flux density) in the lengthwise direction of the fiber axis, such that the fibers of Comparative Example 1 are into anisotropic.

Furthermore, from the results shown in Table 1, it is clearly seen that the quenched ribbon of Comparative Example 2 obtained by a conventional rapid quenching method is an isotropic magnetic material having almost no difference between the magnetic characteristics (coercive force, residual magnetic flux density, and maximum magnetic energy product) in one direction of the ribbon and those in other direction of the ribbon. Although the intrinsic coercive force of the ribbon is a high value of almost about 10 kOe in both the lengthwise direction of the ribbon and the direction perpendicular to the lengthwise direction, the maximum magnetic energy product is less than that of Example 1 in the lengthwise direction of the fiber axis.

On the other hand, the quench-solidified fibers in Example 1 of the present invention provide on anisotropic magnetic material having an intrinsic coercive force of 10 kOe, a sufficiently large residual magnetic flux density, and exhibit excellent performance in the magnetic characteristics (coercive force, residual magnetic flux density, and maximum magnetic energy product) in the lengthwise direction of the fiber axis as compared with the magnetic characteristics (coercive force, residual magnetic flux density, and maximum magnet energy product) in the direction perpendicular to the fiber axis. Therefore, the anisotropic magnet material of Example 1 of the present invention exhibits superior magnetic characteristics (e.g., the maximum magnet energy product) as compared to the quenched ribbons of Comparative Example 2.

COMPARATIVE EXAMPLE 3

Quench-solidified fibers of an alloy composed of 15 atom % Nd, 75 atom % Fe, and 10 atom % B were prepared by the same method of spinning in a rotating liquid as in Example 1 using nozzles having a diameter of 45 μm. The mean diameter and the magnetic characteristics of the fibers thus obtained were measured as in Example 1. The mean diameter of the fibers obtained was 42 μm. Also, both the coercive force thereof in the direction perpendicular to the fiber axis and the coercive force in the lengthwise direction of the fiber axis were measured to be less than 3 kOe. Since the molten metal extruded in a molten state does not stably dive into the silicone oil and a sufficient quenching effect is not obtained, the magnetic characteristics of the quench-solidified fibers are very inferior.

COMPARATIVE EXAMPLE 4

Quench-solidified fibers of an alloy composed of 15 atom % Nd, 75 atom % Fe, and 10 atom % B were prepared by the same method of spinning in a rotating liquid as in Example 1 using nozzles having a diameter of 1,100 μm.

The mean diameter of the fibers thus obtained was 1,200 μm. Even when a silicone oil was used as the cooling medium, a surface oxidation was formed on the fibers. The magnetic characteristics of the fibers were measured as in Example 1. The coercive force in the direction perpendicular to the fiber axis and the coercive force in the lengthwise direction of the fiber axis were about 5 kOe, and the fibrous magnet material did not exhibit anisotropy the magnetic characteristics.

The magnet materials of Comparative Examples 3 and 4 are outside the scope of the present invention with respect to mean fiber diameter. The magnetic characteristics of the fibrous magnet materials produced by a rapid quenching method using an oil as the cooling medium in these comparative examples are inferior to the fibrous magnet obtained in Example 1 of the present invention.

EXAMPLE 2 TO 9

Quench-solidified fibers of the alloys having the composition shown in Table 2 below were prepared by the same manner as in Example 1. Also, the mean diameter, coercive force, and residual magnetic flux density of the fibers thus prepared were measured in the same manner as in Example 1, the results of which are shown in Table 2 below.

TABLE 2

| | Alloy Composition | Mean Diameter | Direction | iHc (kOe) | Br (kG) |
|---|---|---|---|---|---|
| Ex. 2 | $Nd_{14}Fe_{71}Co_8B_7$ | 122 | Perpendicular | 6.3 | 4.5 |
| | | | Lengthwise | 9.8 | 7.0 |
| Ex. 3 | $Nd_{14}Fe_{65}Co_{15}B_6$ | 122 | Perpendicular | 6.3 | 4.5 |
| | | | Lengthwise | 10.5 | 7.0 |
| Ex. 4 | $Nd_{11}Tb_4Fe_{77}B_8$ | 121 | Perpendicular | 7.5 | 4.3 |
| | | | Lengthwise | 11.7 | 6.5 |
| Ex. 5 | $Nd_{11}Dy_4Fe_{77}B_8$ | 120 | Perpendicular | 7.4 | 4.2 |
| | | | Lengthwise | 11.6 | 6.4 |
| Ex. 6 | $Nd_{11}Pr_4Fe_{77}B_8$ | 121 | Perpendicular | 7.2 | 4.4 |
| | | | Lengthwise | 11.3 | 6.8 |
| Ex. 7 | $Nd_{11}Ho_4Fe_{77}B_8$ | 120 | Perpendicular | 7.2 | 4.1 |
| | | | Lengthwise | 11.2 | 6.4 |
| Ex. 8 | $Nd_{11}Ce_4Fe_{77}B_8$ | 121 | Perpendicular | 6.3 | 4.4 |
| | | | Lengthwise | 9.8 | 6.7 |
| Ex. 9 | $Nd_{11}La_4Fe_{77}B_8$ | 122 | Perpendicular | 5.8 | 4.3 |
| | | | Lengthwise | 9.0 | 6.8 |

From the results shown in Table 2 above, it is clearly seen that the fibrous magnet materials of Examples 2 to 9 to the present invention show excellent magnetic characteristics, i.e., intrinsic coercive force of at least 8 kOe even under an applied magnetic filed of 15 kOe, and are anisotropic magnetic materials each having particularly excellent magnetic characteristics (coercive force and residual magnetic flux density) in the lengthwise direction of the fiber axis as compared with the magnetic characteristics (coercive force and residual magnetic flux density) in the direction perpendicular to the fiber axis.

COMPARATIVE EXAMPLE 5

Quench-solidified fibers of an ally composed of 15 atom % Nd, 75 atom % Fe, and 10 atom % B were prepared by the same method of spinning in a rotating liquid as in Example 1 using a dimethyl silicone oil having a viscosity of 1,200 c.p. as the cooling medium.

Then, the quench-solidified fiber obtained was embedded in a resin and cross-sections thereof were observed by an optical microscope. The results showed that the product contained fibers having a elliptical cross-section having a mean diameter of 125 μm. As the result of measuring the magnetic characteristics in the same manner as in Example 1, it was confirmed that both the coercive force in the direction perpendicular to the fiber axis and in the lengthwise direction of the fiber axis were almost 2 kOe, and that the products were fibrous magnetic materials having inferior magnetic characteristics and exhibiting no anisotropy.

In Comparative Example 5, the viscosity of the cooling medium was high, such that the molten metal extruded in the molten state did not stably dive into the medium moving at high speed. A sufficient cooling effect was not obtained to thereby deteriorate the magnetic characteristics of the quench-solidified fibers.

While the invention has been described in detail and with reference to specific examples thereof, it will be apparent to one skilled in the art that various changes and modifications can be made therein without departing from the spirit and scope thereof.

What is claimed is:

1. A process of preparing anisotropic permanent magnet fibers having a mean diameter of from 50 to 1,000 μm and exhibiting magnetic anisotropy, comprising extruding a molten alloy comprising at least one rare earth metal selected from the group consisting of Nd, Pr, Dy, Ho, Tb, La, and Ce in an amount of from 8 to 30 atom %; Fe in an amount of from 12 to 90 atom %; B in an amount of from 2 to 28 atom %; and not more than 30 atom % of Co, into an oil having a viscosity of from 1 to 1,000 c.p. to quench-solidify the molten alloy into a fibrous form.

2. A process as in claim 1, further comprising heat treating the anisotropic quenched permanent magnet fibers at a temperature of from 300° to 800° C. for a time period of from 0.01 to 10 hours.

* * * * *